US005353264A

United States Patent [19]

Corbin, III

[11] Patent Number: 5,353,264

[45] Date of Patent: Oct. 4, 1994

[54] TIDE CALENDER DISK AND METHOD

[76] Inventor: James M. Corbin, III, 17 Elaine Cir., Bellingham, Mass. 02019

[21] Appl. No.: 76,251

[22] Filed: Jun. 11, 1993

Related U.S. Application Data

[63] Continuation-in-part of Ser. No. 891,237, May 29, 1992, abandoned.

[51] Int. Cl.[5] ..... G04B 19/26

[52] U.S. Cl. ..... 368/19

[58] Field of Search ..... 368/15-19

[56] References Cited

U.S. PATENT DOCUMENTS 3,745,313 7/1973 Spilhaus ..... 235/88 R
3,825,181 7/1974 Banner ..... 235/88 R
4,035,617 7/1977 Banner ..... 235/88 N

*Primary Examiner*—Bernard Roskoski
*Attorney, Agent, or Firm*—Thomas A. Kahrl

[57] ABSTRACT

A tide disk in combination with a calibration device for calculating state and time of tide comprising a disk with spiral columns of numerals corresponding to calendar days for the duration of a year for use with reference to a clock face, each numeral being separated by an angular separation of 24.4°; the tide disk including a ring segment of distinctly marked calendar months for positioning the calendar dates in spaced angular arrangement in relationship with the numerals on the clock face for determining condition and time of tide, wherein the calibration is established once a year by setting the calibrator device in a "12 o'clock high position" relative to a time of condition of tide on a specified date.

4 Claims, 2 Drawing Sheets

TIDE CALENDER DISK AND METHOD

This application is a continuation in part of U.S. Patent Application Ser. No. 07/891,237, filed May 29, 1992, now abandoned, which is incorporated herein by reference.

BACKGROUND OF THE INVENTION

Forecasting time of condition of tide is important for anyone whose life touches and concerns the ocean, including those who navigate boats, particularly in coastal tidal areas, those who engage in fisheries including shell fish such as clams and scallops which are harvested at conditions of tide other than high tide, which activity is tide dependent, and those who engage in recreational activities along the seashore. Determining the time of a given tide, be it high or low or intermediate, is relatively easy on a current or day to day basis as tide information is published in a local newspaper, is often carried on the radio, and included on certain calendars. Furthermore, daily tide information is available through the use of well known, conventional "tide clocks" which are mechanically linked to a timing or clock mechanism, which indicate the time of high tide on a daily basis. However, forecasting time of high tide throughout a current month or future months is clearly more difficult task. Typically such forecasting involves the use of tide tables in conjunction with calendars, which often are expensive, cumbersome and typically are not readily available and convenient when making or changing plans which involve tidal waters.

Prior Art tide devices, in particular, tide clock devices, such as U.S. Pat. Nos. 4,848,949 issued 1989, 4,035,617 issued 1977, and 4,623,259 issued 1986 shows use of a display apparatus integrated with a clock mechanism to operate a tide indicating means to show the time of tide on a current daily basis. Another prior tide device is disclosed in U.S. Pat. No. 3,745,313 issued 1973 shows a board with a first scale having index marks signifying days of the year and a second scale having successive sections and index marks indicating the hours of the day. These tide clocks are complex and costly and do not provide a basis for quickly calculating a selected time of condition of tide in future months up to and including a period of twelve months in a simple tide disk.

However, in search of a simple device for fore-casting tides and through analysis of historical tidal records, I determined that the time of next high, or low, or "somewhere in between" tide can be determined by spacing the days date a certain angular distance on a circular display. The time of day, particularly the hour could be compared with this spacing of dates by using a disk display comparable adaptable to be in registration with the face of a conventional clock.

Accordingly it is therefore desirable to provide a simple, quick, convenient, non mechanical, and economical tide disk apparatus and method of calculating a selected condition of tide employing the tide disk which overcomes the disadvantages of the prior art.

SUMMARY OF THE INVENTION

The present invention is directed to an improved tide disk apparatus for use in determining the time of condition of tide at a selected time, at one or more selected locations and at a selected date during a selected year, and to a method of calculating the time of said condition with reference to a conventional clock face for a plurality of months employing the present invention.

In particular the present invention comprises a disk apparatus in combination with a calibration clip apparatus to be calibrated to be in registration with and in reference to a conventional clock face, which is useful in calculating the time of a condition of tide for a plurality of months, typically twelve months, and can also be calibrated to forecast the time of a condition of tide for a plurality of different geographical locations.

In the preferred embodiment the present invention comprises an improved tide disk in combination with a calibration clip apparatus for affixation to a disk configured for displaying calendar dates in a spaced apart circular arrangement. The tide disk is of circular construction characterized by a front display surface of generally flat construction consisting of a thin sheet mounted on the face of the disk for providing a display for a circular arrangement of radially-spaced spiral columns of calendar numerals. The tide disk also includes a back display surface for affixing instructions for use of the Calendar numerals, typically Arabic numerals, are arranged on a series of concentric circles having a center at the central axis of the disk, and includes all the days in each of the 12 months of the year arranged by month. The arrangement of the sequence of calendar numerals numbers typically proceeds from the inside to the outside of the disk, or alternatively may be arranged to proceed from the outer periphery to the central axis according to the wishes of the user.

Angular spacing is provided for determining the separation of the positioning of each calendar date for arrangement in the spiral columns extending radially outward from the central axis. Identification of each month's calendar dates are arranged on two circular paths comprising an outer path including calendar dates for the second half of the month from 16 to 31 and an inner, adjacent path including the calendar dates for the first half of the month from 1 to 15. The angular spacing is set at 24.4° which has been determined the be the critical spacing. This spacing has been calculated by beginning on the first of the month and running 30 days to the 31st, the total number of degrees totaling 732° or twice around 360° plus 12°.

The numerals are provided for designating the day of the month comprising twelve sequences of Arabic numerals from 1 up to and including 31, depending on the month of the year, each sequence on a separate distinctly colored segment. The numerals are arranged in a plurality of at least fifteen concentric spiral columns, wherein the numerals are radially spaced an angular distance of 24.4° for positioning the calendar numerals with reference to and in calibration with a commonly remembered conventional hour numerals on a clock face. In the preferred embodiment the spiral columns of numerals extend radially outwardly from the center of the disk to form a spiral of index calendar numerals.

The tide display disk is formed of a series of concentric ring segments, each ring segment comprising a calender month, there being twelve ring segments corresponding to the twelve months of the calendar year. Each of the ring segment is distinctly marked to signify a distinct calendar month, preferable by marking with a distinct color, with each months calendar dates arranged on circular paths within each ring segment said circular paths comprising an outer path including calendar dates for the second half of the month from 16 to 31 and an inner, adjacent path including the calendar dates for the first half of the month from 1 to 15.

The inner most ring segment having thirty-one numerals corresponding to calendar days in the month of January as shown in FIG. 4, and the next ring comprising twenty-eight days for the month of February. The next ring being for March having a total of thirty-one days. The next ring being for the month of April having a total of thirty days. The next ring being for the month of May having a total of thirty-one days. The next outer ring being for June having a total of thirty days. The next outermost ring being for the month of July having a total of thirty-one days. The next outermost ring being for the month of August having a total of thirty-one days. The next outermost ring being for the month of September having a total of thirty days. The next outermost ring being for the month of October having a total of thirty-one days. The next outermost ring being for the month of November having a total of thirty days and the outermost ring being for the month of December having a total of thirty-one days. For those years other than leap year, the disk for leap year being changed to provide for twenty-nine days in the month of February.

The numerals designate days of a month from 1 to 31, depending on the number of days in a given month, and are arranged such that the time of high tide is the corresponding hour numeral on the face of a conventional clock, particularly a clock with a round dial when the calibration device clip is affixed at the "12 o'clock high position." For example if a calendar numeral was positioned at the bottom of the disk, being adjacent the hour numeral of six, the time of high time would be at six. In as much as the tide is approximately one half hour later in the evening, the accuracy of the disk is in the range of + or − half an hour.

Colors may be varied according to choice, one such choice being the colors of birth stones as follows:

| | |
|---|---|
| January | Garnet (reddish) |
| February | Amethyst (purple) |
| March | Aqua Marine (bluish-green) |
| April | Diamond |
| May | Emerald (green) |
| June | Pearl |
| July | Ruby (dark red) |
| August | Peridot (yellow-green) |
| September | Sapphire (blue) |
| October | Opal or Pink Turmeline |
| November | Topaz (dark orange) |
| December | Turquoise or Blue Zircon |

Furthermore, since time and height of tide vary from location to location, a geographic variation device comprising a spring clip with an identification device is provided for adjusting to different locations by use of an indexing clip device including a hanger device for hanging the disk in a vertical arrangement and a geographical label adapted to be attached to the outer edge of the disk for showing the time differential in different tides cycles on a given day. The tide discs are adapted for use in those areas of the world which are characterized by semi diurnal tides, i.e. having two tides a day, typically the east coast of the United States. The adjustable feature of the disk is particularly adapted for adjustment by the user from actual observation by the user for his precise location and can be adjusted from time to time to adjust for variations resulting from inaccuracy of initial setting or other factors.

In the preferred embodiment, the tide disk is adapted to be attached to a wall or clock and set for the geographical variation for the location selected and thereafter used as a means for calculating or determining the time of condition of tide at a selected hour and a selected date for the balance of the selected month and year by reference to the disk.

The following is an example of how a condition of tide may be predicted. Calculation of the time of a given tide condition at a given coastal location for a given date is accomplished by following the steps set forth hereinafter. Referring to FIG. 1, it is first necessary to calibrate the tide disk by affixing the calibration pointer to the peripheral edge of the tide disk, however, having once calibrated the tide disk it will remain calibrated for a period of one year, except for the situation of a leap year which is discussed later. Calibration is accomplished by first referring to a tide reference such as a local tide chart or actual observance of tide on a given day to determine the time of the condition of tide for a selected location. Calibration can be either for time of condition of tide which may be varied (i.e. it can be either calibrated for a high tide or low tide or an intermediate tide). For example, on January 3rd referring to a table/newspaper/radio announcement or actual observation, the time of high tide is established as 3 PM. Referring to the FIG. 1, the month of January is located by a ring segment configuration identified by the month and also identified by a color. Having located the disk ring segment for the month of January, the date is then located, i.e. the numeral "3" is located within the January ring segment. The calibration device consisting of a clip with pointer and hanger is then clipped to the calibration position outer peripheral edge of the tide disk with reference to said numeral "3", by establishing a "Twelve o'clock high" position wherein the tide disk is aligned with respect to the well known positions of the numerals on the hour hand positions of a clock such that said numeral "3" is aligned with the 3 PM position of a typical clock face. This can be done in a number of ways, however according to the invention, a clip spring with pointer and hanger is attached to the "twelve o'clock high position" such that said numeral "3" in the January circle remains in the 3 o'clock position when the clip is hung on a wall or placed on the table. The spring clip device is the calibrating device and having been established for one date in the month, for one date is then good for the balance of the year for a specific location. To determine the time of tide at a different day and a different month i.e. for the month of June if we select the day of June 3rd we will see that numeral "3" for June is at the six o'clock position relative to the "12 o'clock high position" and therefore the time of high tide on June 3rd is 6 o'clock.

Any other date in any other month, the time of high tide can be determined by reference to the position of the date in the colored circle for a given month and relating it with reference to the 12 o'clock high position to determine the hour of high tide, the time of low tide being 6 hours difference would be the reciprocal hour hand in respect to the "12 o'clock high" position or would be at 2 o'clock. Optionally if user is more interested in low tide (i.e. if he is engaged in clamming) he can calibrate the time such that the date numeral falls at the time of low tide (i.e. and that the high tide therefore is in the reciprocal position on the disk tide surface). It is intended that the tide disk according to the invention be re-calibrated once a year by resetting the position of the calibrating clip in reference to a tide table or other document to reset the time of the recalibrate for the first of January. In a further embodiment of the invention, a time of high tide for January 1st for a plurality of years (i.e. ten years) can be fastened on the back of the disk for reference for re-calibrating by means of a stitcher.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
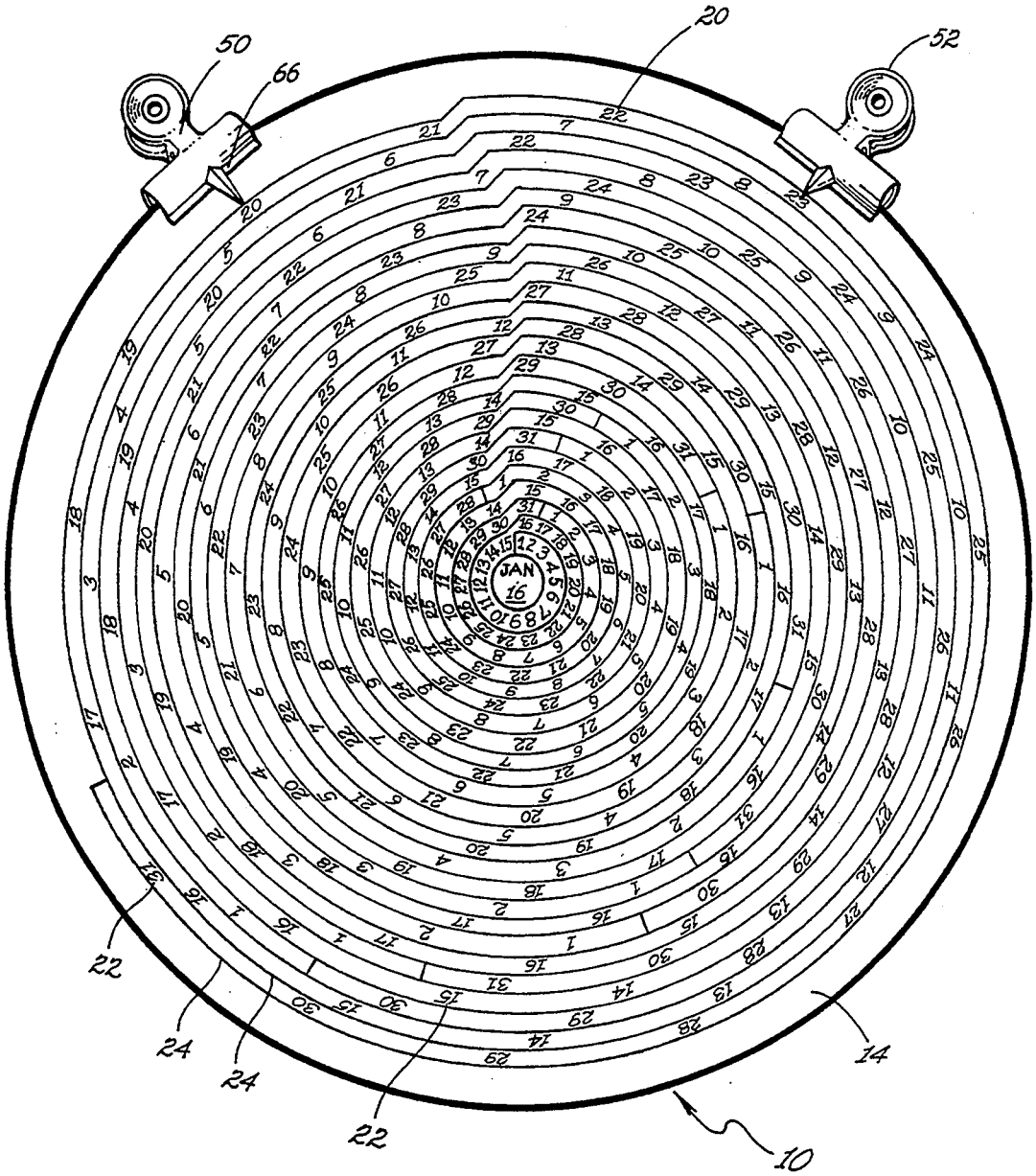
FIG. 1 is a front plan view of the tide disk apparatus according to the preferred embodiment of the present invention, with the calibrating apparatus in a selected "12 o'clock high" position.

Referring to the drawings, there is shown a tide disk apparatus 10 including a flat circular disk 12 having a faced template 14 attached to the front of said tide disc. The disk 12 comprises a front surface, a central axis 16 and an outer circumferential edge 18 and includes a plurality of calendar numerals 20, circularly arranged in a plurality of at least fifteen spiral columns 22. Said spiral columns extend radially outward across a series of circular paths 24, wherein said calendar numerals are radially spaced by an angular spacing of 24.4°, for positioning the calendar numerals in a circular arrangement on the face template 14 to relate to conventional and well known hour numerals on a conventional clock face.

As shown in FIG. 1, the angular positioning of the calendar numerals 20 on the face template 14 may be related to the positioning of traditional hour numerals, typically being circumferentially spaced on the dial face of a conventional clock.

Figure 2:
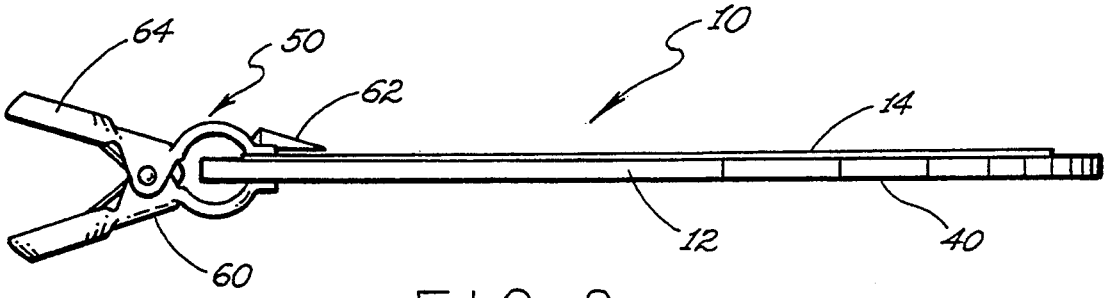
FIG. 2 is a side view of the invention of FIG. 1.
Figure 3:
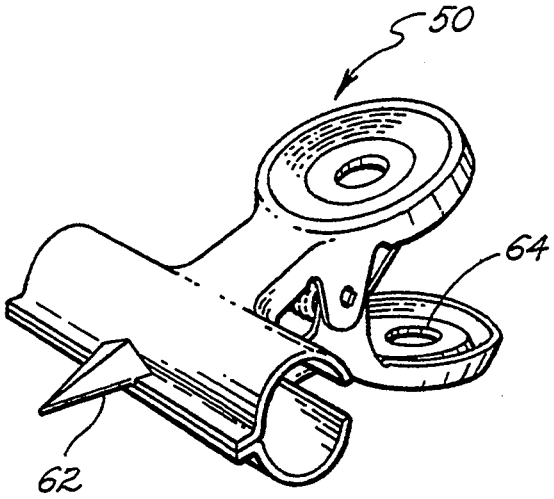
FIG. 3 is an enlarged side view of the indexing clip of the invention of FIG. 1.
Figure 4:
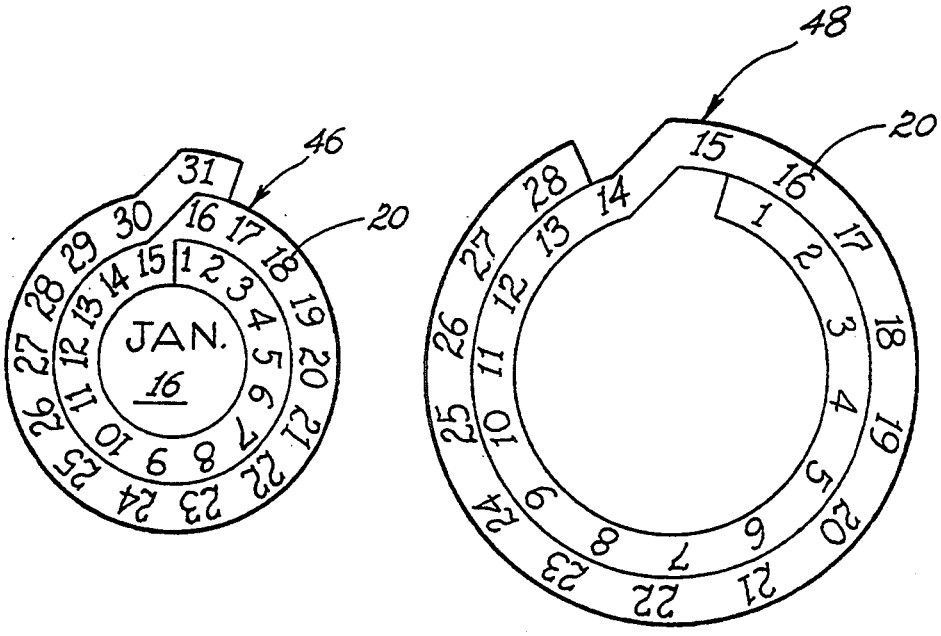
FIG. 4 is a front plan view showing exploded and segregated ring segments for the months of January and February for the tide disk apparatus shown in FIG. 1.

Referring to FIG. 2, the tide disk apparatus 10 is of circular construction adapted to be mounted directly on a flat surface such as a table, with the front surface 14 and a rear surface 40, said disc consisting of a thin, sheet of material. The calendar numerals 20 shown in FIG. 1, designate the day of the month comprising Arabic Numerals from 1 to 31, for a series of twelve months to complete a full calendar year. FIG. 4 shows circular segment 46 for the month of January and circular segment 48 for the month of February. In this embodiment the disk 12, is adapted to be hand held, or alternatively, hung on a wall, not shown, wherein a calibration clip 50 having a conventional spring clip device, 60 a pointer device 62 and a hanger device 64, may be attached to the disc 12 at a "12 o'clock high position" 66 for calibration of the tide disc for a calendar year. Also, a geographic indexing clip 52 of similar construction, is included for providing a variation parameter for adjusting to different locations having tide cycles on a given day, as is shown in FIG. 1.

The invention also can be employed to determine the time of condition of tide at alternate locations having differing tide conditions. According a second color code be provided such that a reference to the color can be identified by the user (i.e. the series of brown, blue, green, pink, yellow, orange covers a span of six months and then it is repeated as shown with brown, blue, green, pink, yellow and orange, as is set forth in the Exhibits of the application showing color). The disk 12 is adapted to be preferably hung on a wall by means of the hanger 64 attached to the calibration clip 50 having apertures for accepting a hanger or nail. The disk 12 can alternately be used on a flat table surface as previously mentioned. In a further application, the disk can be applied directly to the face of a clock by removing the hour and the minute hand, placing the tide disk over the face of the clock and replacing the hour and minute hands and replacing the lens. In the clock location, the disk is fixed to the face of the clock and does not move and is not in any way related to the clock mechanism and will not need to be calibrated for a year. While in practice, the disk would obliterate the hours markings on the clock face since the hour position is well recognized, they are not necessary on the clock face and in point of fact, many clock faces do not include hour hand markings for one reason or another.

What is claimed is:

1. A tide disk apparatus adapted for determining condition of tide at a selected time, at a selected date for a plurality of calendar months with reference to a conventional circular clock face comprising:

a) disk means for providing on a circular disk numeral means for days of each month of a year in a sequentially arranged spiral arrangement;

b) wherein said numeral means designates days of each calendar month, comprising a plurality of numerals radially spaced in a spiral arrangement (comprising Arabic numerals from 1 to 31);

c) angular separation means for radially spacing said numerals by an angular spacing related to a tide cycle arranged in spiral columns radiating outwardly from the central axis comprising an angular spacing of 24.4°;

d) calibration means for establishing a "12 o'clock high position" of a selected calendar date for the timing of condition of tide, comprising a calibration clip;

e) month segment means for displaying different months in a distinct manner, comprising sequential segments of a spiral path distinctly marked to signify a distinct calendar month wherein said months are arranged in a calendar secession; and f) geographic variation means for adjusting to different locations having different tides cycles on a given day; wherein angular positioning of the numeral means relates to the "12 o'clock high position" and where the position of numeral designating the calendar date indicates the time of high tide on that calendar date and wherein the geographic variation means is indexed to a regional reference location for adjusting to different locations having different tide cycles on a given day and wherein the geographic variation means includes a hanger means for hanging said disk apparatus in a vertical arrangement.

2. The tide disk apparatus of claim 1 wherein the disk means comprises a circular disk, having a front surface and a rear surface, and consisting of a thin sheet of material.

3. The tide disk apparatus of claim 1 wherein the month segment means are made distinct by identifying each month by a distinctive color background.

4. The tide disk apparatus of claim 1 wherein the disk means is constructed of a template sheet mounted on a base.

* * * * *